US007383714B2

(12) United States Patent
DiMilia et al.

(10) Patent No.: US 7,383,714 B2
(45) Date of Patent: Jun. 10, 2008

(54) CRIMP MACHINE WITH QUICK RELEASE PUSHERS

(75) Inventors: Robert Anthony DiMilia, Toledo, OH (US); Anthony Eugene Sheckler, Columbia City, IN (US); Christopher Bernard Andreas, Columbia City, IN (US); Michael Paul Beining, Holland, OH (US)

(73) Assignee: Eaton Corporation, Cleveland, OH (US)

( * ) Notice: Subject to any disclaimer, the term of this patent is extended or adjusted under 35 U.S.C. 154(b) by 315 days.

(21) Appl. No.: 11/237,502

(22) Filed: Sep. 28, 2005

(65) Prior Publication Data

US 2007/0072484 A1 Mar. 29, 2007

(51) Int. Cl.
*B21D 39/04* (2006.01)

(52) U.S. Cl. ..... 72/402; 29/237

(58) Field of Classification Search ..... 72/402, 72/416; 29/237, 282, 283.5
See application file for complete search history.

(56) References Cited

U.S. PATENT DOCUMENTS 3,742,754 A * 7/1973 Jeromson et al. ..... 72/402
3,851,514 A * 12/1974 Chen et al. ..... 72/402
4,034,592 A * 7/1977 Chen et al. ..... 72/402
4,034,593 A * 7/1977 Patel ..... 72/402
4,118,970 A * 10/1978 Patel ..... 72/402
4,250,607 A * 2/1981 Lillbacka et al. ..... 29/237
4,885,928 A * 12/1989 Davis et al. ..... 72/402
4,887,451 A * 12/1989 Hoff et al. ..... 72/402

* cited by examiner

*Primary Examiner*—Daniel C Crane
(74) *Attorney, Agent, or Firm*—Rader, Fishman & Grauer PLLC

(57) ABSTRACT

A crimp machine includes a linear mover that forces a ram plate assembly toward a base plate to radially contract an insert. The insert has an inner surface defining an interior dimension that mates with a fitting and crimps the fitting onto a flexible hose as the insert is radially contracted. To adjust for fittings of differing dimensions, a plurality of inserts of varying inside dimensions may be used. To make the crimp machine adjustable for a wide range of fitting dimensions, a plurality of adapter rings of differing inner diameters may be employed. Each adapter ring is removably interposed within a base plate aperture and has a differing inner surface for mating with an insert of desired proportions.

25 Claims, 7 Drawing Sheets

CRIMP MACHINE WITH QUICK RELEASE PUSHERS

TECHNICAL FIELD

The technical field relates generally to crimp machines for attaching fittings to the ends of hydraulic hoses and more specifically to a crimp machine with easily interchangeable base plate adapter rings.

BACKGROUND

There are many applications where a hose is used to transport a fluid. Typically, the hose is connected to an end fitting by crimping a portion of the end fitting over the hose. The end fitting includes an inner portion interposed within the hose and an outer portion defining an outer surface that is crimped into a binding engagement with the hose. A force is transmitted through the outer surface to plastically deform the outer portion. Prior art crimp machines that are adjustable for a range of fitting outer surface diameters typically include multiple dies with a consistent outer diameter for mating with the crimp machine and a different inner diameter for mating with the different outer surface diameters. A practical range of outer surface fitting diameters are accommodated with a single die outer diameter, as each die must have a minimum thickness, or distance between the outer diameter and the inner diameter, and each die has a practical maximum thickness.

Therefore, a drawback to typical crimp machines is that a limited range of fitting sizes may be crimped. In order to accommodate fittings of a size that is greater than the practical size for a given crimp machine, a portion of the crimp machine that mates with the die outer diameter may be adjustable to accommodate a range of sizes of die outer diameters. This adjustability has not been easily incorporated into prior art crimp machines mainly due to the compactness of the machines that affords limited space to provide for adjustment. While a crimp machine that is intended for only a narrow range of fitting diameters may not require this adjustability, the need to crimp fittings of a wide range of fitting diameters while readily adjusting a crimp machine for the different fitting diameters has not been met by the prior art.

SUMMARY

Crimp machines for attaching end fittings onto hoses are disclosed. One disclosed embodiment provides an apparatus for attaching a fitting to a hose. The apparatus includes a linear mover generally defining an axis A-A and selectively providing a generally linear force generally parallel to the axis A-A. The apparatus also includes a base plate selectively coupled to the linear mover, wherein the base plate defines a base plate aperture and the axis A-A extends through the base plate aperture. The apparatus additionally includes an adapter ring selectively interposed within the base plate aperture. The adapter ring defines a generally frusto-conical inner surface. The apparatus further includes a radially contractible insert selectively interposed within the adapter ring and axially moveable therein. The insert selectively cooperates with the frusto-conical inner surface to contract the insert as the insert moves generally along a direction parallel to the axis A-A, and the insert is selectively coupled to an uncrimped fitting for transmitting a crimping force to the fitting. The apparatus also includes a ram plate assembly. The ram plate assembly includes a first pusher portion having a first generally hemi-cylindrical portion. The ram plate assembly also includes a second pusher portion having a second generally hemi-cylindrical portion. The first and second pusher portions selectively transmit a force from the linear mover to the insert. The first pusher portion is selectively moveable to permit removal of the adapter ring from the base plate aperture.

Another disclosed embodiment provides an apparatus for attaching a fitting to a hose. The apparatus includes a linear mover generally defining an axis A-A and selectively providing a generally linear force generally parallel to the axis A-A. The apparatus also includes a base plate selectively coupled to the linear mover and an adapter ring selectively coupled to the base plate. The adapter ring defines a generally frusto-conical inner surface. The apparatus further includes a radially contractible insert selectively interposed within the adapter ring and axially moveable therein. The insert selectively cooperates with the frusto-conical inner surface to contract the insert as the insert moves generally along a direction parallel to the axis A-A, and the insert is selectively coupled to an uncrimped fitting for transmitting a crimping force to the fitting. The crimping force is applied generally perpendicular to the A-A axis. The apparatus also includes a ram plate assembly including a first pusher portion having a first generally hemi-cylindrical portion. The first pusher portion selectively transmits a force from the linear mover to the insert. The first pusher portion is selectively moveable to permit the removal of the adapter ring from the base plate aperture.

BRIEF DESCRIPTION OF THE DRAWINGS

The present invention will now be described, by way of example, with reference to the accompanying drawings, in which.

DETAILED DESCRIPTION

Figure 1:
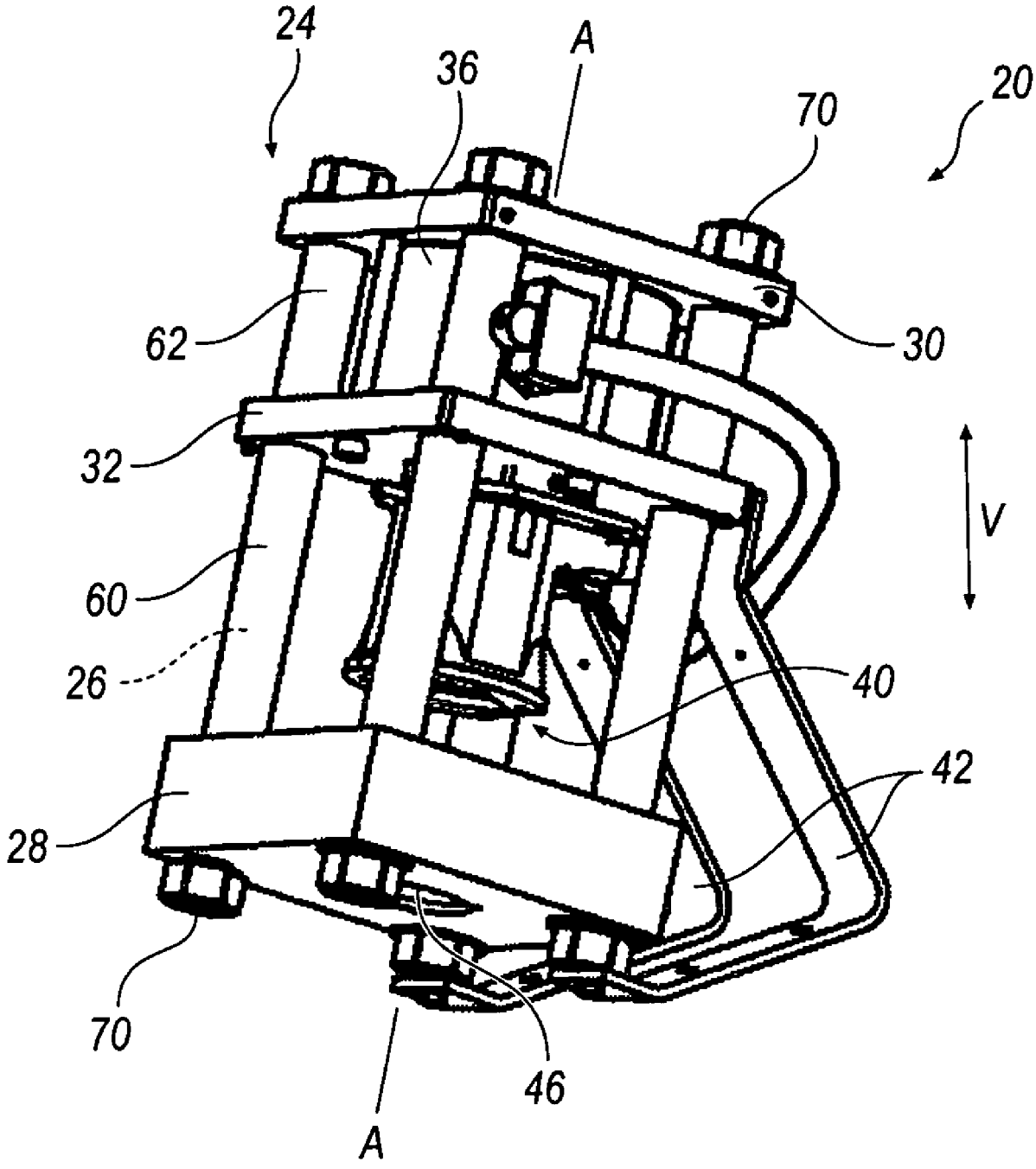
FIG. 1 is a perspective view of a crimp machine according to an exemplary embodiment.
Figure 2:
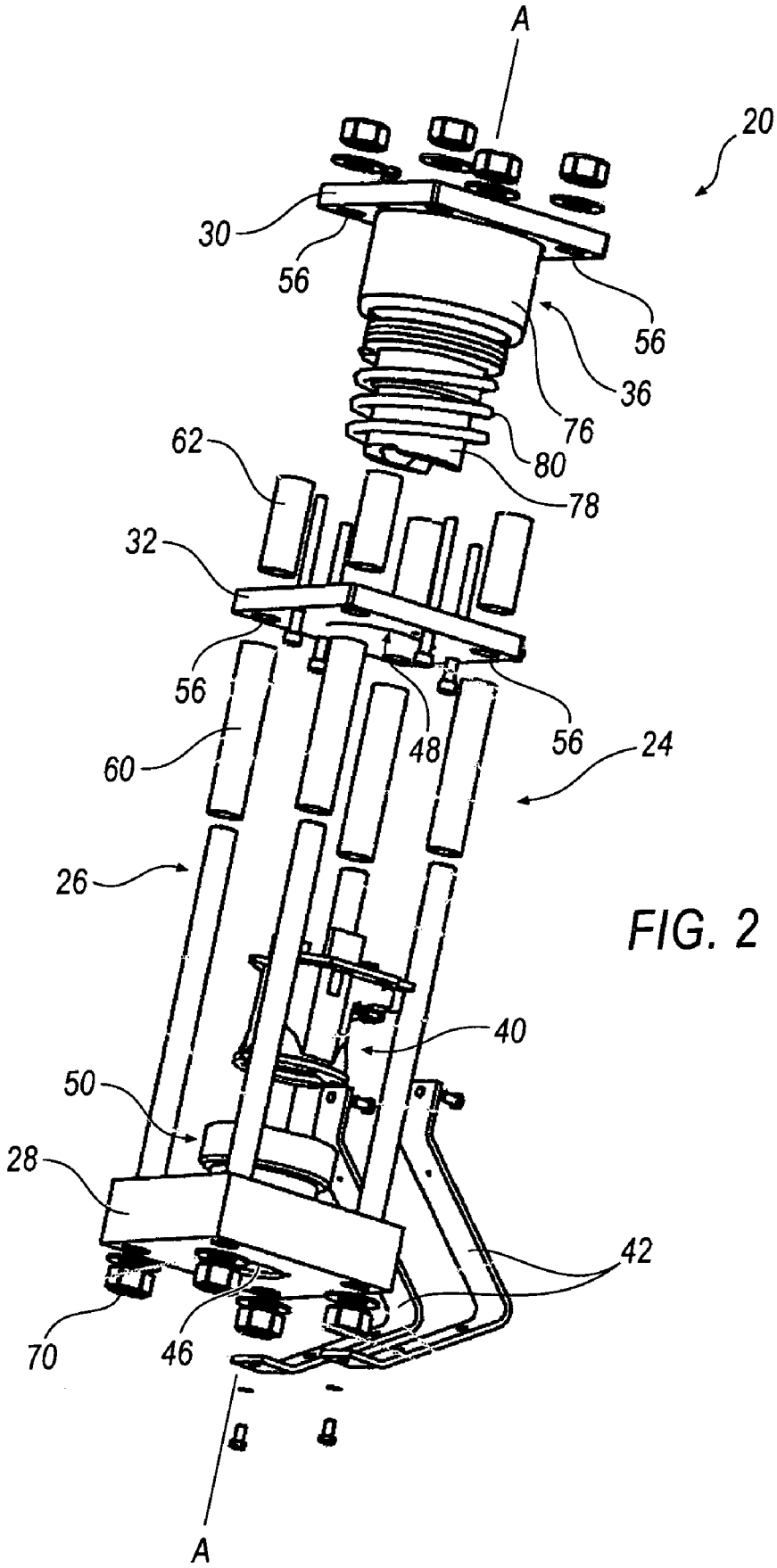
FIG. 2 is an exploded perspective view of the crimp machine of FIG. 1.

Referring to FIGS. 1 and 2, a crimp machine 20 is illustrated. Crimp machine 20 includes a frame 24 having elongated frame members 26 interconnecting a base plate 28, a top plate 30, and a middle plate 32. Crimp machine 20 further includes a linear mover 36 at least partially interposed between the top plate 30 and the middle plate 32. Linear mover 36 generally defines an axis A-A. Crimp machine 20 also includes a ram plate assembly 40 at least partially interposed between the base plate 28 and the middle plate 32. Crimp machine 20 may include a pair of support brackets 42 in order to mount the crimp machine 20 in an orientation where axis A-A is at an acute angle with a vertical axis V (FIG. 1). Base plate 28 includes a base plate aperture 46 formed therein (FIG. 2). Middle plate 32 includes a middle plate aperture 48 formed therein. Crimp machine 20 also includes an insert assembly, shown generally at 50 in FIG. 2.

As best seen in FIG. 2, plates 28, 30, 32 include frame apertures 56 formed therein. Elongated frame members 26 are each inserted through a frame aperture 56 of each plate 28, 30, 32. A lower spacer 60 is positioned between base plate 28 and middle plate 32 as a frame member 26 is inserted therethrough. An upper spacer 62 is positioned between middle plate 32 and top plate 30 as a frame member 26 is inserted therethrough. Both the lower spacer 60 and the upper spacer 62 have outer dimensions that are greater than the diameters of frame apertures 56. Preferably, elongated frame members 26 are at least partially threaded rods with nuts 70 mated to either end to secure frame 24 as illustrated in FIG. 1. As best seen in FIG. 1, frame 24 provides a stable connection between top plate 30 and base plate 28 while restricting relative movement therebetween.

With continuing reference to FIG. 2, linear mover 36 includes a housing 76 and a piston 78. While linear mover 36 is preferably a hydraulic cylinder that exerts a linear force, discussed below, as piston 78 extends from housing 76, in other embodiments linear mover 36 may be a pneumatic cylinder or other device known in the art. In the embodiment shown, a return spring 80 is used, at least in part, to retract piston 78 into housing 76. Piston 78 extends through middle plate aperture 48. Piston 78 may contact a portion of ram plate assembly 40, to translate ram plate assembly 40 generally parallel to the axis A-A, as discussed below. Linear mover 36 is positioned within crimp machine 20 such that top plate 30 resists a force exerted by housing 76 as piston 78 exerts a force $F_L$ on ram plate assembly 40, as discussed in greater detail below. Preferably, frame members 26 have a resistance to tensile failure much greater than the output of the linear mover 36.

Figure 3:
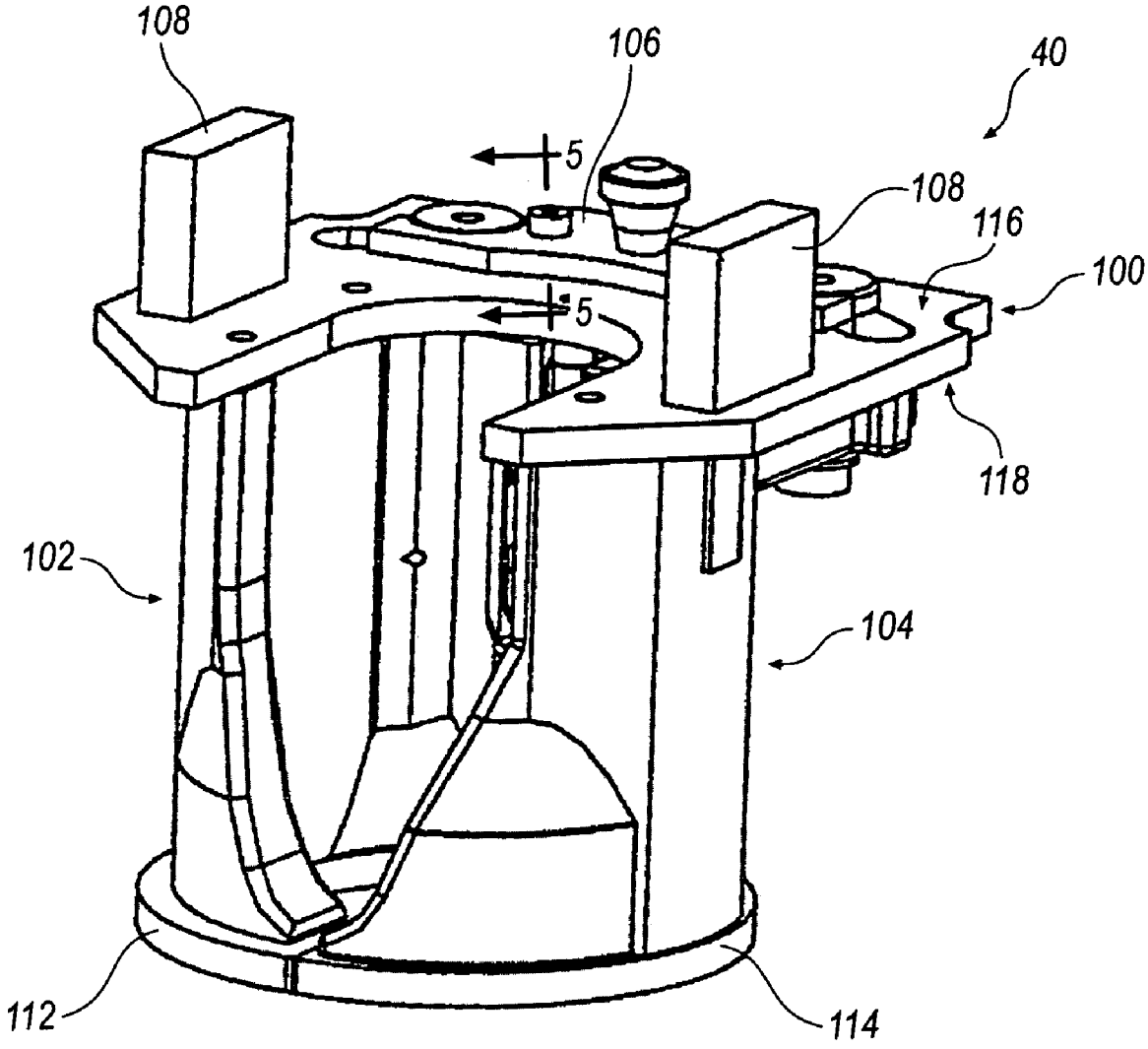
FIG. 3 is a perspective view of a ram plate assembly portion of the crimp machine of FIG. 1.
Figure 4:
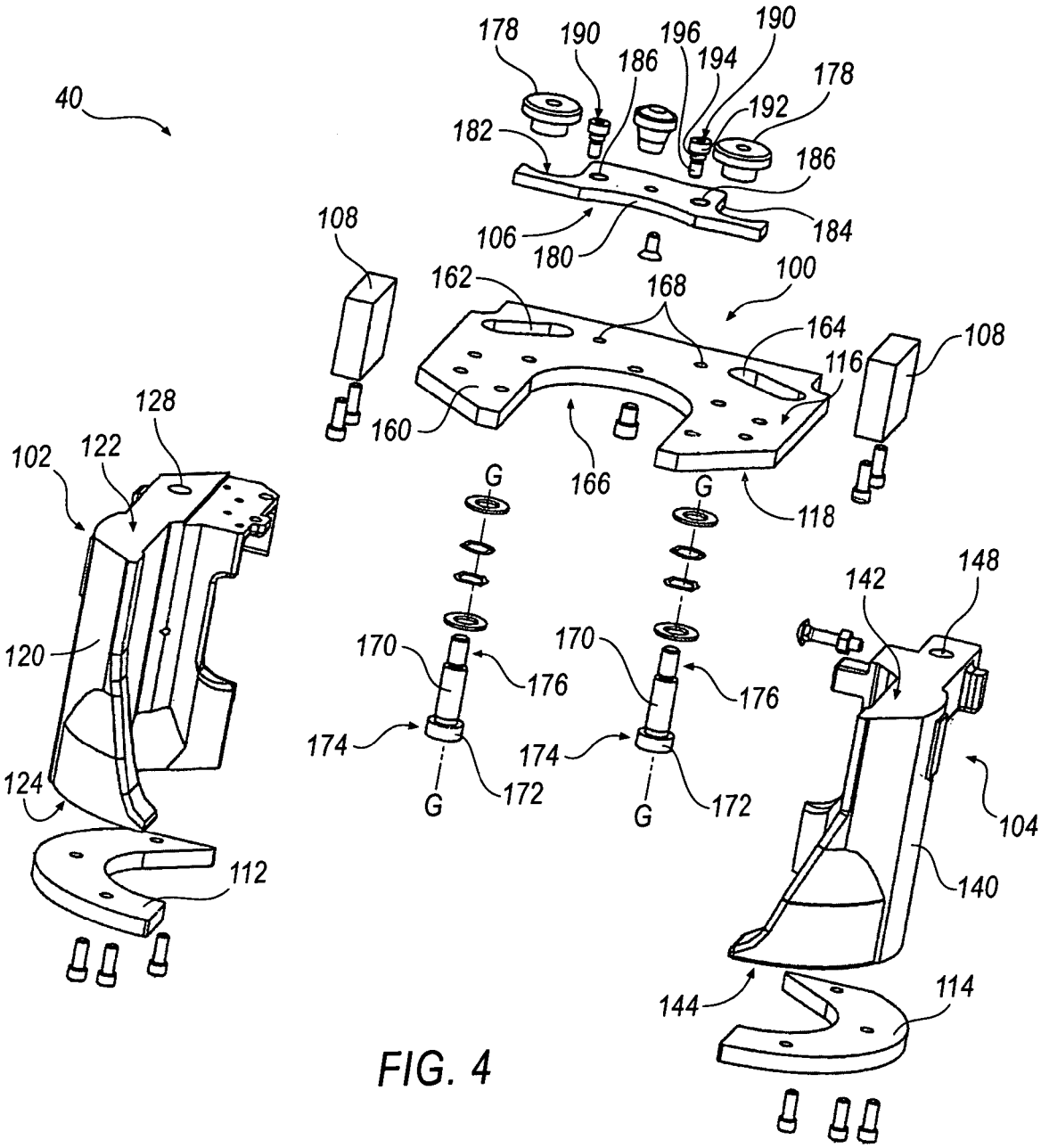
FIG. 4 is an exploded perspective view of the ram plate assembly portion of FIG. 3.

With reference to FIGS. 3 and 4, the ram plate assembly 40 includes a ram plate 100, a first pusher portion 102, a second pusher portion 104, a ram plate bracket 106, a pair of ram blocks 108, a first wear plate 112, and a second wear plate 114. Ram plate 100 has an upper ram surface 116 and a lower ram surface 118. With brief reference to FIGS. 2-4 collectively, upper ram surface 116 of ram plate 100 is selectively in contact with piston 78, and is preferably attached to piston 78.

Referring again to FIG. 4, first pusher portion 102 has a generally hemi-cylindrical body 120 defined, at least in part, by a first upper pusher surface 122, a first lower pusher surface 124, and a first hinge attachment location 128. Second pusher portion 104 has a generally hemi-cylindrical body 140 defined, at least in part, by a second upper pusher surface 142, a second lower pusher surface 144, and a second hinge attachment location 148.

The first wear plate 112 is attached to the first pusher portion 102 adjacent the first lower pusher surface 124. The second wear plate 114 is attached to the second pusher portion 104 adjacent the second lower pusher surface 144. Ram blocks 108 are attached to ram plate 100 adjacent upper ram surface 116.

The ram plate 100 further includes a generally planar body 160 that includes a first slot 162, a second slot 164, a central opening 166, and a pair of guide pin securing apertures 168. The ram plate assembly 40 further includes a pair of hinge pins 170. Hinge pins 170 each define an axis G-G and include a head 172 at a first end 174 and a threaded surface 176 opposite the first end 174. An internally threaded T-nut 178 releasably couples to the threaded surface 176. A hinge pin 170 is interposed within the first hinge attachment location 128 of the first pusher portion 102, the first slot 162, and a T-nut 178. Another hinge pin 170 is interposed within the second hinge attachment location 148 of the second pusher portion 104, the second slot 164, and a T-nut 178. Each hinge pin 170 is allowed to rotate and translate within the respective slot 162, 164, thereby permitting the first pusher portion 102 and the second pusher portion 104 to rotate about an axis generally parallel to axis A-A, and to translate generally perpendicular to the axis A-A.

Figure 5:
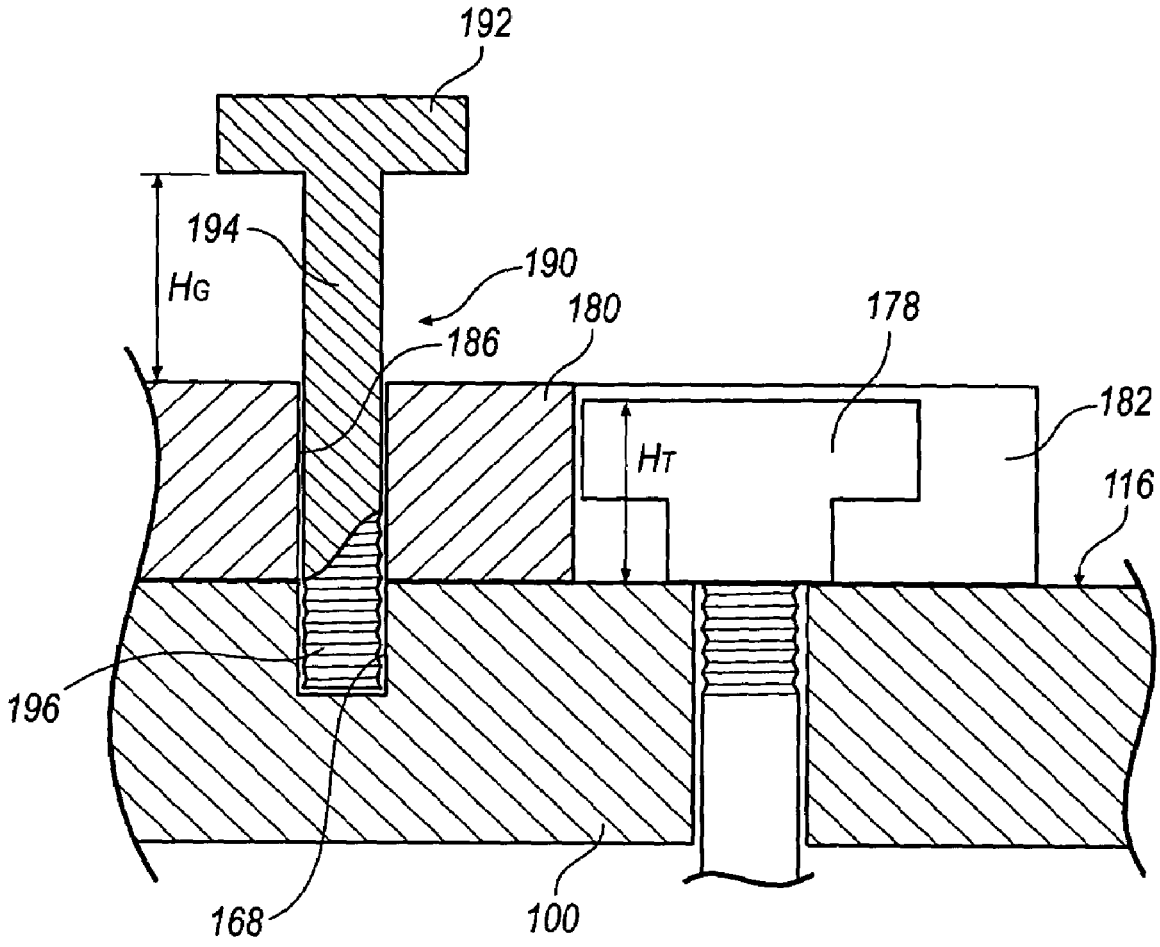
FIG. 5 is a partial sectional view of a guide pin according to a representative embodiment, taken along line 5-5 of FIG. 3.

The ram plate bracket 106 includes a generally planar bracket body 180 having a first stop surface 182, a second stop surface 184, and a pair of guide pin receiving apertures 186 formed therein. A pair of guide pins 190 are interposed within guide pin receiving apertures 186 and threaded into guide pin securing apertures 168. As best seen in FIGS. 3 and 5, guide pins 190 each include a head 192, a shaft 194, and a threaded surface 196 at the end of shaft 194 opposite head 192. As best seen in FIG. 5, threaded surface 196 is threaded into guide pin securing apertures 168. As best seen in FIGS. 3-5, hinge pins 170 are restrained from translation generally perpendicular to the axis A-A within slots 162, 164 due to the interference between T-nuts 178 and stop surfaces 182, 184.

When guide pins 190 are coupled to guide pin securing apertures 168 (as best seen in FIG. 5), guide pins 190 allow the bracket body 180 to be lifted from upper ram surface 116. As also best seen in FIG. 5, $H_G$ is the distance that the bracket body 180 may be lifted from upper ram surface 116. $H_T$ is the distance that T-nut 178 extends above upper ram surface 116. $H_G$ is greater than $H_T$, thereby allowing the bracket body 180 to be lifted to clear the interference between T-nut 178 and stop surfaces 182, 184. When bracket body 180 is lifted to at least this extent, the pusher portions 102, 104 may be translated or propelled as hinge pins 170 move within slots 162, 164 generally perpendicular to axis A-A. Regardless of the position of bracket body 180 relative upper ram surface 116, pusher portions 102, 104 may rotate as hinge pins 170 rotate within slots 162, 164.

Figure 6:
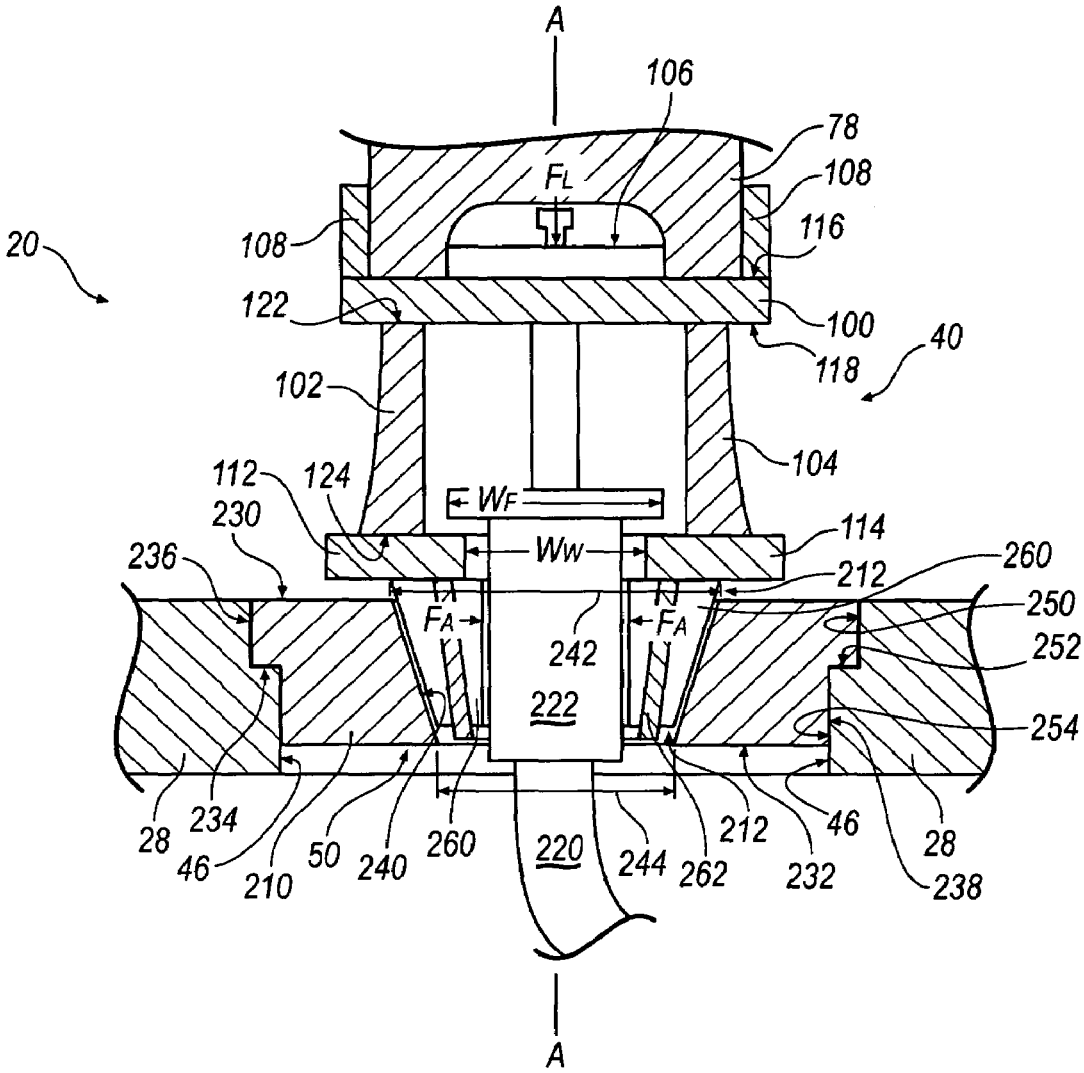
FIG. 6 is a partial sectional view of the crimp machine of FIG. 1, with some portions removed and some portions not to scale for clarity.

Referring now to FIG. 6, the insert assembly 50 is illustrated in greater detail. Insert assembly 50 includes an adapter ring 210 and an insert 212. FIG. 6 also illustrates a hose 220 and a fitting 222 generally positioned in a desired location for crimping fitting 222 onto hose 220, as discussed in greater detail below.

Adapter ring 210 is generally annular and includes a top surface 230, a bottom surface 232, a transition surface 234, a first outer diameter 236, a second outer diameter 238, and a frusto-conical inner surface 240 defining a greater diameter 242 and a lesser diameter 244. Base plate aperture 46 is defined by a first diameter 250, a transition portion 252, and a second diameter 254 smaller than the first diameter 250. Adapter ring 210 may be removably inserted into base plate aperture 46. As best seen in FIG. 6, pusher portions 102, 104 may be in an orientation that prevents adapter ring 210 from being removed from base plate aperture 46.

Figure 8:
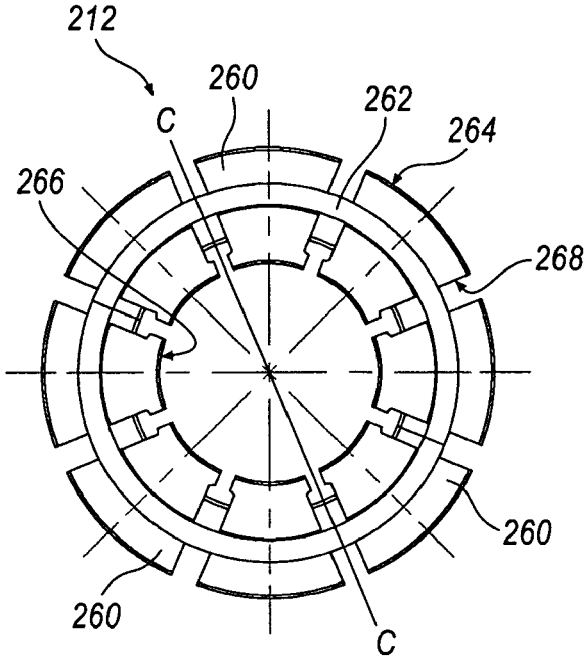
FIG. 8 is a top view of an insert of the crimp machine of FIG. 1.
Figure 9:
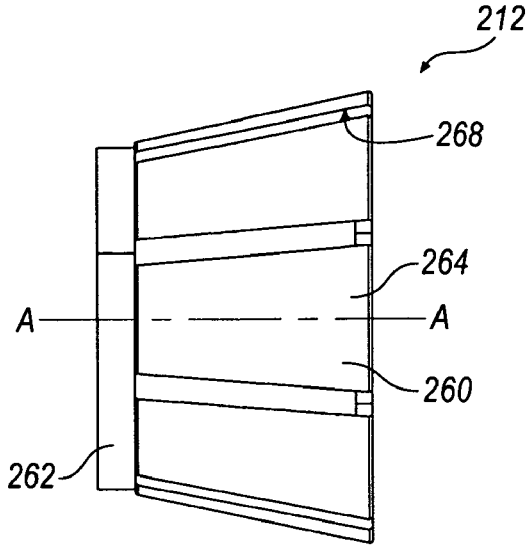
FIG. 9 is a side view of the insert of FIG. 8.

With reference to FIGS. 6, 8 and 9, insert 212 includes a plurality of curvilinear wedges 260 interconnected by a flexible ring 262. As best illustrated in FIGS. 8 and 9, each wedge 260 includes an outer curved surface 264, an inner curved surface 266 (FIG. 8), and a pair of mating surfaces 268. Flexible ring 262 will compress at least to the extent that mating surfaces 268 of all wedges 260 converge. Flexible ring 262 may also permit mating surfaces 268 of adjacent wedges 260 to contact. Outer curved surfaces 264 of the wedges 260 form a discontinuous frusto-conical surface that preferably mates with the frusto-conical inner surface 240. Inner curved surfaces 266 of the wedges 260 form a discontinuous generally hemi-cylindrical surface that preferably mates with a portion of the fitting 222. Preferably, insert 212 is provided as a two-piece assembly, with flexible ring 262 cut along line C-C in FIG. 8.

Figure 10:
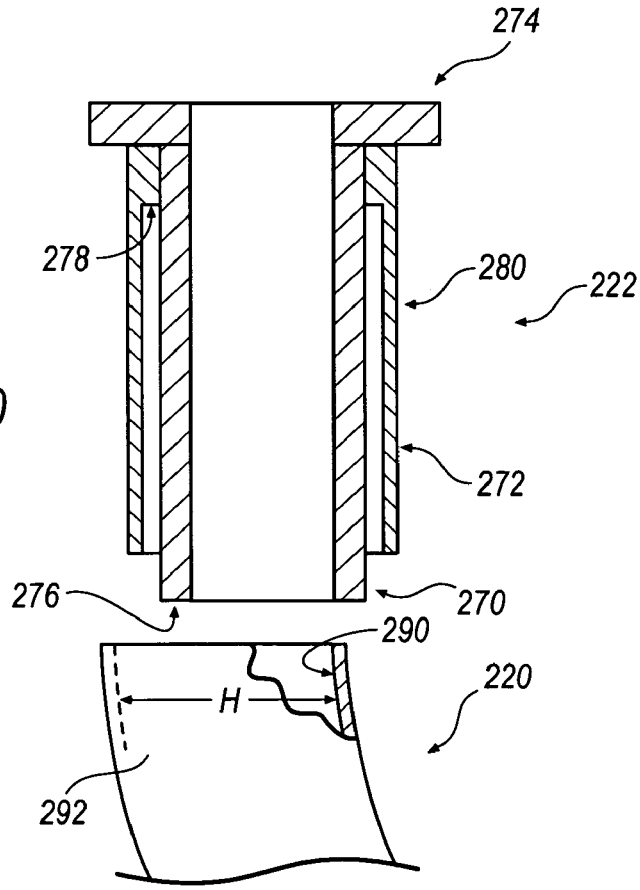
FIG. 10 is a partial sectional view of a hose and fitting for use with the crimp machine of FIG. 1

FIG. 10 illustrates hose 220 and fitting 222 in greater detail. Fitting 222 includes an inner portion 270, an outer portion 272, a coupling end 274, a hose receiving end 276, and an annular hose stop surface 278. Outer portion 272 is defined, in part, by an outer fitting crimp surface 280. Fitting 222 has a maximum outer dimension perpendicular to axis A-A of $W_F$ (FIG. 6). Hose 220 includes an inner hose surface 290 defining a hose inner diameter H, and an outer hose surface 292. As best illustrated in FIG. 6, wear plates 112, 114 define an interior dimension $W_W$ therebetween.

The hose 220 may be inserted into fitting 222 until hose 220 contacts hose stop surface 278. Hose 220 and fitting 222 may then be positioned within the crimp machine 20, as illustrated in FIG. 6.

Figure 7:
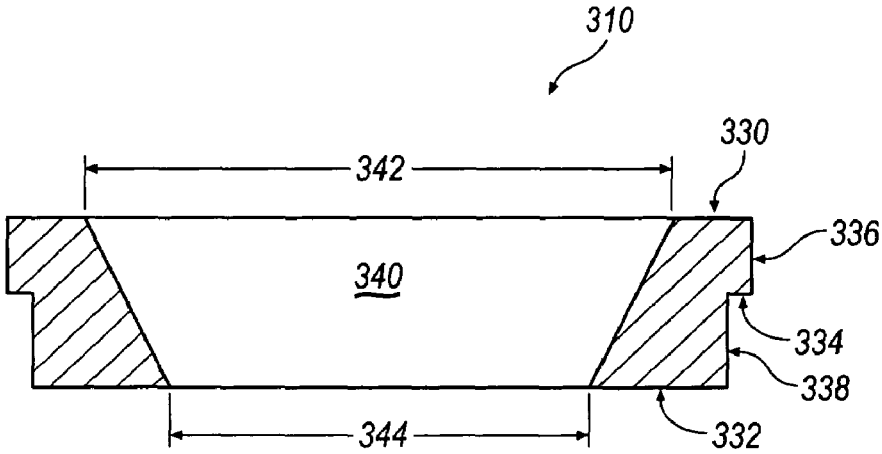
FIG. 7 is a sectional view of an adapter ring according to an embodiment.

With reference to FIG. 7, an alternative embodiment of the adapter ring 210 is illustrated as adapter ring 310. Adapter ring 310 is generally annular and includes a top surface 330, a bottom surface 332, a transition surface 334, a first outer diameter 336, a second outer diameter 338, and a frusto-conical inner surface 340 defining a greater diameter 342 and a lesser diameter 344. Preferably, greater diameter 342 is a larger dimension than greater diameter 242, and lesser diameter 344 is a larger dimension than lesser diameter 244. Accordingly, inserts with larger outer dimensions for fittings of larger outer dimensions may be used with adapter ring 310.

The adapter rings 210, 310 are preferably both supplied with the crimp machine 20 to permit a wider range of fitting outer dimensions. Adapter rings 210, 310 may be of single piece construction or of multiple piece construction, being segmented axially, radially, or otherwise to provide a similar function. Insert 212 may be supplied with varying dimensions, to mate with the frusto-conical inner surfaces 240, 340, or otherwise and transmit a crimping force to the outer fitting crimp surface, (such as outer fitting crimp surface 280), of a fitting.

With specific reference to FIG. 6, an exemplary operation of the crimp machine 20 will be described. A desired adapter ring 210, 310 is inserted into base plate aperture 46. Then, a desired size insert, such as insert 212, is interposed within the selected adapter ring. Pusher portions 102, 104 may then be translated, or propelled, such that hinge pins 170 move within slots 162, 164 generally perpendicular to the respective axis G-G and pusher portions 102, 104 move generally perpendicular or generally tangential to the axis A-A. Pusher portions 102, 104 may then be rotated toward axis A-A such that wear plates 112, 114 are aligned with insert 212 for transmitting a force as ram plate assembly 40 translates generally along axis A-A.

With specific reference to FIGS. 6 and 10, a hose 220 with fitting 222 coupled thereto is inserted through insert 212 such that coupling end 274 is moved generally along axis A-A past insert 212 and extending beyond wear plates 112, 114. With fitting 222 in this position, inner curved surfaces 266 of insert 212 will contact outer fitting crimp surface 280 of fitting 222 when insert 212 is contracted.

As a user holds hose 220 and fitting 222 in the desired position described above, power is supplied to linear mover 36. Linear mover 36 transmits a force generally parallel to axis A-A that causes piston 78 to move ram plate assembly 40 generally parallel to axis A-A toward base plate 28. As ram plate assembly 40 moves toward base plate 28, wear plates 112, 114 contact insert 212, causing insert 212 to move generally parallel to axis A-A away from top plate 30.

As insert 212 moves away from top plate 30, interaction between outer curved surfaces 264 of insert 212 and frusto-conical inner surface 240 of adapter ring 210 cause the wedges 260 of insert 212 to converge as ring 262 is compressed. As wedges 260 converge, inner curved surfaces 266 of insert 212 contact outer fitting crimp surface 280 of fitting 222. As piston 78 is forced to move further toward base plate 28, inner curved surfaces 266 of insert 212 apply a radial force $F_A$ to outer fitting crimp surface 280 of fitting 222. As the radial force $F_A$ is applied to outer fitting crimp surface 280, outer portion 272 of fitting 222 is crimped onto the outer hose surface 292, thereby capturing hose 222 between inner portion 270 and outer portion 272. Thus provided, crimp machine 20 coverts a force that is generally parallel to the axis of a fitting to a force that is generally radial to the fitting in order to crimp, or bindingly engage, the fitting to a hose.

Preferably, an insert, such as insert 212, is created for each fitting, such as fitting 222, of different outer fitting crimp surface dimensions and different crimping force desired values. Also preferably, the insert 212 and the adapter ring 210 are sized such that wear plates 112, 114 will contact the adapter ring 210 when fitting 222 has been crimped a desired amount. With this configuration, overcrimping will be reduced and additional controls are not needed to prevent overrun of linear mover 36. Hose 220 is preferably rubber, metal, or any combination of materials desired.

After the fitting 222 has been crimped to a desired amount, piston 78 is retracted toward top plate 30, causing ram plate assembly 40 and insert 212 to move toward top plate 30 and wedges 260 to diverge. As wedges 260 diverge, the fitting 222 may be removed from crimp machine 20. When a fitting of a slightly different outer dimension than fitting 222 is desired to be crimped by crimp machine 20, first and second pusher portions 102, 104 are rotated relative axes G-G and insert 212 is removed. An insert similar to insert 212, with inner curved surfaces of slightly different dimensions as inner curved surfaces 266 may be interposed within adapter ring 210.

When a fitting of a sufficiently different outer dimension than fitting 222 is desired to be crimped by crimp machine 20 such that a different adapter ring, such as adapter ring 310, is required, first and second pusher portions 102, 104 are rotated relative axes G-G and translated generally tangential to axis A-A in order to eliminate the interference between wear plates 112, 114 and adapter ring 210. Adapter ring 210 is removed from base plate aperture 46 and an adapter ring, such as adapter ring 310, is inserted into base plate aperture 46. An insert compatible with the installed adapter ring may then be inserted into the installed adapter ring and first and second pusher portions 102, 104 returned to the operational configuration of FIG. 6. In this manner, inserts as well as adapter rings may be readily interchanged in order to accommodate a wide range of outer dimensions of fittings to be crimped by crimp machine 20.

While insert assembly 50 is illustrated as including an adapter ring 210 and an insert 212, insert assembly 50 may include other components or similar components that effectively convert the linear force $F_L$ to the radial force $F_A$.

Although insert 212 is illustrated with eight wedges 260, an insert for use with crimp machine 20, such as insert 212, includes at least four wedges 260 to practically apply a force radially to outer portion 272 of fitting 222. Generally, hoses, such as hose 220, for higher pressure applications benefit from a larger number of wedges 260 in an insert, such as insert 212.

While first pusher portion 102 and second pusher portion 104 are illustrated as rotating in different angular directions in a clam-shell type orientation, ram plate assembly 40 may be alternatively constructed so as to permit the pusher portions 102, 104 to be moved in the same direction to permit removal of the adapter ring 210 from the base plate 28.

While the invention has been described with respect to specific examples including preferred modes of carrying out the invention, those skilled in the art will appreciate that there are numerous variations and permutations of the above described systems and techniques that fall within the spirit and scope of the invention as set forth in the appended claims.

What is claimed is:

1. An apparatus for bindingly attaching a fitting to a hose, comprising:

a linear mover generally defining an axis and selectively providing a generally linear force generally parallel to the axis;

a base plate selectively coupled to said linear mover, wherein said base plate defines a base plate aperture and said axis extends through said base plate aperture;

an adapter ring selectively interposed within said base plate aperture, wherein said adapter ring defines a generally frusto-conical inner surface;

a radially contractible insert having an inner surface and selectively interposed within said adapter ring and axially moveable therein, wherein said insert selectively cooperates with said frusto-conical inner surface to contract said insert as said insert moves generally along a direction parallel to the axis, and said insert is selectively coupled to the fitting for transmitting a crimping force thereto;

a ram plate assembly including:

a first pusher portion, and a second pusher portion, wherein said first and second pusher portions selectively transmit a force from said linear mover to said insert; and a ram plate selectively coupled to said first pusher portion and said second pusher portion, wherein said first pusher portion is selectively moveable to permit the removal of said adapter ring from said base plate aperture, wherein said ram plate is selectively coupled to said first pusher portion such that said first pusher portion may be propelled generally perpendicular to the axis, and wherein said ram plate includes a slot formed therein to permit said first pusher portion to move generally perpendicular or generally tangential to the axis.

2. The apparatus of claim 1, further comprising a frame member selectively coupling said insert to at least a portion of said linear mover, and restraining relative movement in a direction generally parallel to the axis therebetween.

3. The apparatus of claim 1, wherein said linear mover is a hydraulic cylinder.

4. The apparatus of claim 1, wherein said linear mover is a pneumatic cylinder.

5. The apparatus of claim 1, wherein said inner surface of said insert is formed of generally hemi-cylindrical portions.

6. The apparatus of claim 1, wherein said insert selectively crimps at least a desired portion of the fitting onto the hose.

7. The apparatus of claim 1, wherein said first pusher portion is selectively rotated to permit the removal of said adapter ring from said base plate aperture.

8. The apparatus of claim 7, wherein said second pusher portion is selectively rotated to permit the removal of said adapter ring from said base plate aperture.

9. The apparatus of claim 1, wherein said ram plate is selectively rotatably coupled to said first pusher portion.

10. The apparatus of claim 1, wherein said first pusher portion includes a wear plate selectively interposed between said first generally hemi-cylindrical portion and said insert.

11. The apparatus of claim 1, wherein said insert has a generally annular section taken perpendicular to the axis, and said insert includes a plurality of curvilinear wedges each selectively moveable in a generally radial direction with respect to the axis.

12. The apparatus of claim 1, wherein the fitting includes an inner portion selectively interposed within the hose and an outer portion, and the outer portion is selectively crimped onto the hose.

13. The apparatus of claim 1, wherein the crimping force is applied generally perpendicular to the axis.

14. The apparatus of claim 1, wherein said first pusher portion may be selectively rotated about an axis generally parallel to the axis in a first angular direction and said second pusher portion may be selectively rotated about an axis generally parallel to the axis in a second angular direction.

15. The apparatus of claim 1, wherein said first pusher portion is translated generally parallel to the axis in a first direction and said second pusher portion is translated generally perpendicular to the axis in a second direction.

16. The apparatus of claim 1, wherein said insert includes at least four wedges.

17. An apparatus for attaching a fitting to a hose, comprising:

a linear mover generally defining an axis and selectively providing a generally linear force generally parallel to the axis;

a base plate selectively coupled to said linear mover;

an adapter ring selectively coupled to said base plate, wherein said adapter ring defines a generally frusto-conical inner surface;

a radially contractible insert selectively interposed within said adapter ring and axially moveable therein, wherein said insert selectively cooperates with said frusto-conical inner surface to contract said insert as said insert moves generally along a direction parallel to the axis, and said insert is selectively coupled to an uncrimped fitting for transmitting a crimping force to the fitting, and wherein the crimping force is applied generally perpendicular to the axis;

a ram plate assembly including a first pusher portion having a first generally hemicylindrical portion and a ram plate selectively coupled to said first pusher portion, wherein sais first pusher portion selectively transmits a force from said linear mover to said insert;

wherein said ram plate includes a slot formed therein to permit said first pusher portion to move generally perpendicular or generally tangential to the axis; and wherein said first pusher portion is selectively moveable to permit the removal of said adapter ring from said base plate aperture.

18. The apparatus of claim 17, wherein said first pusher portion is selectively rotated to permit the removal of said adapter ring from said base plate aperture.

19. The apparatus of claim 17, wherein said insert includes at least four wedges.

20. The apparatus of claim 17, wherein the crimping force is applied generally perpendicular to the axis.

21. The apparatus of claim 17, wherein said insert is selectively coupled to a fitting and the fitting is interposed within said insert such that the fitting is generally concentric to the axis.

22. An apparatus for bindingly attaching a fitting to a hose, comprising:

a linear mover generally defining an axis and selectively providing a generally linear force generally parallel to the axis;

a base plate selectively coupled to said liner mover, wherein said base plate defines a base plate aperture and said axis extends through said base plate aperture;

an adapter ring selectively interposed within said base plate aperture, wherein said adapter ring defines a generally frusto-conical inner surface;

a radially contractible insert having an inner surface and selectively interposed within said adapter ring and axially moveable therein, wherein said insert selectively cooperates with said frusto-conical inner surface to contract said insert as said insert moves generally along a direction parallel to the axis, and said insert is selectively coupled to the fitting for transmitting a crimping force thereto; and a ram plate assembly including:

a first pusher portion, and a second pusher portion, wherein said first and second pusher portions selectively transmit a force from said linear mover to said insert; and a ram portion selectively coupled to said first pusher portion and said second pusher portion, wherein said first pusher portion is selectively moveable to permit the removal of said adapter ring from said base plate aperture, wherein at least said ram portion is selectively coupled to said first pusher portion such that said first pusher portion may be propelled generally perpendicular to the axis, and wherein said first pusher portion may be selectively rotated about an axis generally parallel to the axis in a first angular direction.

23. The apparatus of claim 22, wherein said insert has a generally annular section taken perpendicular to the axis, and said insert includes a plurality of curvilinear wedges each selectively moveable in a generally radial direction with respect to the axis.

24. The apparatus of claim 23, wherein said insert includes at least four wedges.

25. The apparatus of claim 22, wherein the fitting includes an inner portion selectively interposed within the hose and an outer portion, and the outer portion is selectively crimped onto the hose.

* * * * *

UNITED STATES PATENT AND TRADEMARK OFFICE

CERTIFICATE OF CORRECTION

PATENT NO. : 7,383,714 B2
APPLICATION NO. : 11/237502
DATED : June 10, 2008
INVENTOR(S) : DiMilia et al.

It is certified that error appears in the above-identified patent and that said Letters Patent is hereby corrected as shown below:

Col. 8
In claim 17, line 60, replace “sais” with --said--.

Signed and Sealed this

Second Day of September, 2008

JON W. DUDAS
*Director of the United States Patent and Trademark Office*